US010533744B2

(12) United States Patent
Taimura

(10) Patent No.: US 10,533,744 B2
(45) Date of Patent: Jan. 14, 2020

(54) HEATER AND GLOW PLUG EQUIPPED WITH SAME

(71) Applicant: KYOCERA Corporation, Kyoto-shi, Kyoto (JP)

(72) Inventor: Kotaro Taimura, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 312 days.

(21) Appl. No.: 15/537,950

(22) PCT Filed: Oct. 29, 2015

(86) PCT No.: PCT/JP2015/080580

§ 371 (c)(1),
(2) Date: Jun. 20, 2017

(87) PCT Pub. No.: WO2016/103908

PCT Pub. Date: Jun. 30, 2016

(65) Prior Publication Data

US 2017/0350596 A1 Dec. 7, 2017

(30) Foreign Application Priority Data

Dec. 25, 2014 (JP) ..... 2014-261596

(51) Int. Cl.

| | |
|---|---|
| ***F23Q 7/00*** | (2006.01) |
| ***H05B 3/48*** | (2006.01) |
| ***H05B 3/06*** | (2006.01) |
| ***H05B 3/14*** | (2006.01) |
| ***F23Q 7/06*** | (2006.01) |

(52) U.S. Cl.

CPC ..... *F23Q 7/001* (2013.01); *F23Q 7/06* (2013.01); *H05B 3/06* (2013.01); *H05B 3/148* (2013.01); *H05B 3/48* (2013.01); *F23Q 2007/002* (2013.01); *H05B 2203/027* (2013.01)

(58) Field of Classification Search

CPC F01P 2070/04; F01P 7/16; F01P 7/167; F02P 19/02; F23Q 7/001; G05D 23/1921; H05B 2203/027; H05B 3/48

USPC ..... 219/250–270; 425/116; 264/104, 255; 29/611; 123/145; 338/200, 300

See application file for complete search history.

(56) References Cited

U.S. PATENT DOCUMENTS 4,502,430 A * 3/1985 Yokoi ..... F23Q 7/001 123/145 A
6,744,016 B2 * 6/2004 Watanabe ..... C04B 41/009 123/145 A (Continued)

FOREIGN PATENT DOCUMENTS

JP 2007-240080 A 9/2007
WO WO-2011065366 A1 * 6/2011 ..... F23Q 7/001

*Primary Examiner* — Tu B Hoang
*Assistant Examiner* — Vy T Nguyen
(74) *Attorney, Agent, or Firm* — Volpe and Koenig, P.C.

(57) ABSTRACT

A heater includes a ceramic body of bar shape; and a heat-generating resistor disposed in an inside of the ceramic body, when viewed in a transverse section, the heat-generating resistor including at least one step portion provided in an outer periphery part of the heat-generating resistor, the at least one step portion having such a shape that semicircular portions bisected in a diametrical direction of the heat-generating resistor deviate from each other along the diametrical direction.

12 Claims, 9 Drawing Sheets

(56) References Cited

U.S. PATENT DOCUMENTS

| | | | | |
|---|---|---|---|---|
| 2002/0162830 | A1* | 11/2002 | Taniguchi | F23Q 7/001 219/270 |
| 2006/0011602 | A1* | 1/2006 | Konishi | F23Q 7/00 219/270 |
| 2009/0320782 | A1* | 12/2009 | Hiura | F23Q 7/001 123/145 A |
| 2010/0155389 | A1* | 6/2010 | Yamamoto | H05B 3/141 219/548 |
| 2011/0253704 | A1* | 10/2011 | Yamamoto | F23Q 7/001 219/544 |
| 2015/0014302 | A1* | 1/2015 | Ikai | H05B 3/48 219/544 |

* cited by examiner

HEATER AND GLOW PLUG EQUIPPED WITH SAME

TECHNICAL FIELD

The present disclosure relates to a heater utilized as a heater for ignition or for flame detection used in a combustion-type vehicle-mounted heating apparatus or the like, a heater for ignition used in a burning appliance of diverse kind such as a kerosene fan heater, a heater for glow plug used in a diesel engine, a heater for sensor of diverse kind such as an oxygen sensor, a heater for heating used in measuring equipment, or any other heater; and a glow plug provided with the same.

BACKGROUND ART

As a heater, for example, a ceramic heater disclosed in Japanese Unexamined Patent Publication JP-A 2007-240080 (referred to as Patent Literature 1, hereinafter) is known. The ceramic heater disclosed in Patent Document 1 includes: a substrate having a bar shape and formed of ceramics; and a heat-generating element buried in the substrate. The heat-generating element includes a pair of bar-shaped electrically conductive parts extending in an axial direction thereof. Then, the conductive part has a circular shape when viewed in a cross section perpendicular to the axial direction.

In recent years, a heater capable of more rapidly raising the temperature is required. In order to rapidly raise the temperature of the heater, a high current need be supplied to the heat-generating element of the heater. Nevertheless, when a high current is supplied to the heat-generating element, a possibility arises that heat generation occurs locally in a part of the heat-generating element so that a large thermal expansion occurs in that part of the heat-generating element. Then, a possibility is caused that the large thermal expansion having occurred in the heat-generating element generates cracks between the heat-generating element and the ceramic-made substrate. In particular, like in the ceramic heater disclosed in Patent Literature 1, when the cross section of the heat-generating element has a circular shape, generated cracks easily propagate along the interface between the heat-generating element and the substrate and hence a possibility is caused that the cracks grow in the circumferential direction. As a result, gaps are generates between the heat-generating element and the substrate so that the heat generated in the heat-generating element becomes difficult to be transmitted to the substrate and hence a possibility of degradation of the long term reliability of the heater is caused.

SUMMARY OF INVENTION

A heater comprises a ceramic body of bar shape and a heat-generating resistor provided in an inside of the ceramic body, when viewed in a transverse section, the heat-generating resistor comprising at least one step portion provided in an outer periphery part of the heat-generating resistor, the at least one step portion having such a shape that semicircular portions bisected in a diametrical direction of the heat-generating resistor deviate from each other along the diametrical direction.

A glow plug comprises a heater having the above-mentioned constitution, the heat-generating resistor being located on one end side of the ceramic body; and a metal tube disposed so as to cover the other end side of the ceramic body.

DESCRIPTION OF EMBODIMENTS

Figure 1:
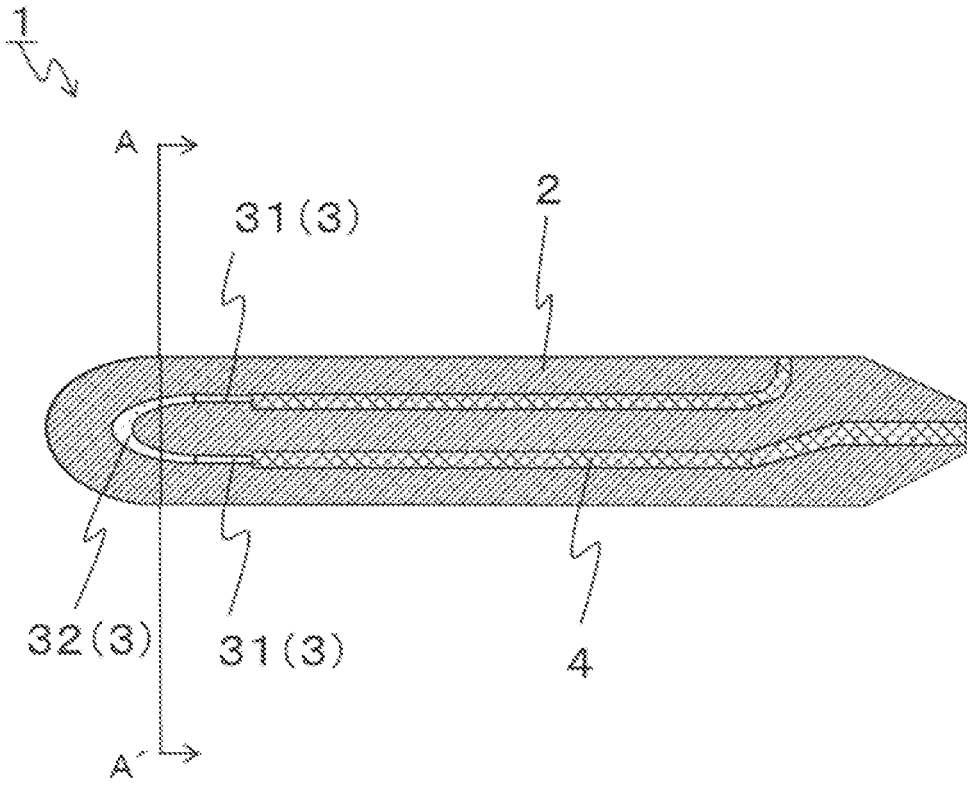
FIG. 1 is a sectional view showing an example of an embodiment of a heater.

As shown in FIG. 1, a heater 1 includes: a ceramic body 2; a heat-generating resistor 3 buried in the ceramic body 2; and leads 4 connected to the heat-generating resistor 3 and then drawn out to a surface of the ceramic body 2.

For example, the ceramic body 2 in the heater 1 is formed in a bar shape having a longitudinal direction thereof. The heat-generating resistor 3 and the leads 4 are buried in the ceramic body 2. Here, the ceramic body 2 is formed of ceramics. This realizes the heater 1 having higher reliability at the time of rapid temperature raising. Employable ceramics include ceramics having electrical insulation such as oxide ceramics, nitride ceramics, and carbide ceramics. In particular, the ceramic body 2 is preferably formed of silicon-nitride based ceramics. This is because, in the silicon-nitride based ceramics, silicon nitride contained as the main component is excellent from the perspectives of strength, toughness, insulation, and heat resistance. For example, the ceramic body 2 formed of silicon-nitride based ceramics can be obtained in such a manner that: 3 to 12 mass % of rare-earth element oxide such as $Y_2O_3$, $Yb_2O_3$ or $Er_2O_3$ serving as a sintering aid, 0.5 to 3 mass % of $Al_2O_3$, and $SiO_2$ of an amount adjusted such that the $SiO_2$ amount contained in the sintered compact becomes 1.5 to 5 mass % are mixed into silicon nitride serving as the main component; then, the material is formed into a predetermined shape; and, after that, hot press firing is performed at 1650° C. to 1780° C. For example, a length of the ceramic body 2 is set to be 20 to 50 mm. Further, for example, a diameter of the ceramic body 2 is set to be 3 to 5 mm.

Here, when the ceramic body 2 formed of silicon-nitride based ceramics is employed, it is preferable that $MoSiO_2$, $WSi_2$, or the like is mixed and dispersed therein. In this case, the thermal expansion coefficient of the silicon-nitride based ceramic serving as the base material can be made close to the thermal expansion coefficient of the heat-generating resistor 3 so that the durability of the heater 1 can be improved.

The heat-generating resistor 3 is provided in the inside of the ceramic body 2. The heat-generating resistor 3 is provided on a tip side (on one end side) of the ceramic body 2. The heat-generating resistor 3 is a member for generating heat by supplying an electric current. The heat-generating resistor 3 is composed of: two straight parts 31 extending along the longitudinal direction of the ceramic body 2; and a folded part for linking together the two straight parts 31.

Materials employable for the formation of the heat-generating resistor 3 include materials composed mainly of carbide, nitride, silicide, or the like of W, Mo, Ti, or the like. When the ceramic body 2 is formed of silicon-nitride based ceramics, tungsten carbide (WC) among the above-mentioned materials is excellent as the material of the heat-generating resistor 3 from the perspectives of a small difference in the thermal expansion coefficient from the ceramic body 2 and high heat resistance.

Further, when the ceramic body 2 is formed of silicon-nitride based ceramics, it is preferable that the heat-generating resistor 3 is formed of a material composed mainly of inorganic electroconductive material WC and containing silicon nitride added at a content percentage of 20 mass % or higher. For example, in the inside of the ceramic body 2 formed of silicon-nitride based ceramics, the conductor component serving as the heat-generating resistor 3 has a higher thermal expansion coefficient than silicon nitride, and hence a tensile stress usually acts on the heat-generating resistor. In contrast, when silicon nitride is added in the heat-generating resistor 3, the thermal expansion coefficient is made close to that of the ceramic body 2 so that the stress caused by the difference between the thermal expansion coefficients at the time of temperature raising and temperature lowering of the heater 1 can be alleviated.

Further, when the content of silicon nitride contained in the heat-generating resistor 3 is 40 mass % or lower, fluctuation in resistance of the heat-generating resistor 3 can be made small. Thus, it is preferable that the content of silicon nitride contained in the heat-generating resistor 3 is 20 mass % to 40 mass %. More preferably, the content of silicon nitride is 25 mass % to 35 mass %. Further, in place of the silicon nitride, as a similar additive added to the heat-generating resistor 3, 4 mass % to 12 mass % of boron nitride may be added. The overall length of the heat-generating resistor 3 may be set to be 3 to 15 mm and the cross-sectional area may be set to be 0.15 to 0.8 $mm^2$.

Figure 2:
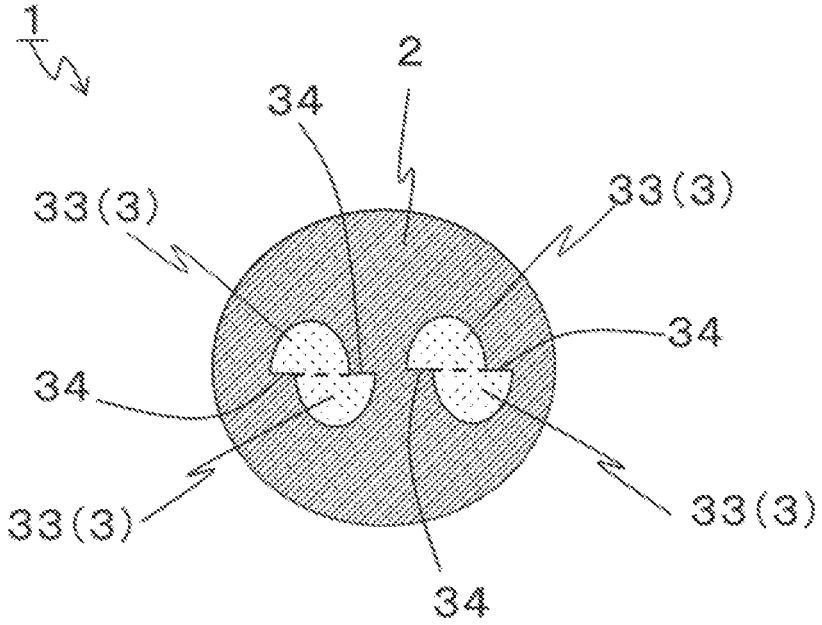
FIG. 2 is a transverse sectional view of a heater shown in FIG. 1, taken along line A-A'.

As shown in FIG. 2, when viewed in a transverse section, the heat-generating resistor 3 comprises at least one step portion 34 provided in the outer periphery part, the at least one step portion 34 having such a shape that a pair of semicircular portions 33 bisected in a diametrical direction deviates from each other along the diametrical direction. Here, the "transverse section" mentioned here indicates a cross section obtained by cutting at a plane perpendicular to the longitudinal direction of the heat-generating resistor 3. In particular, in the heater 1, in each of the two straight parts 31, a shape is formed such that the semicircular portions 33 of the same size deviate from each other along the diametrical direction. Thus, two step portions 34 are present in the outer periphery part of each of the straight parts 31. As such, since the heat-generating resistor 3 has the step portions 34 in the outer periphery part, even when cracks supposedly occur between the heat-generating resistor 3 and the ceramic body 2 and then the cracks are to grow along the interface between the heat-generating resistor 3 and the ceramic body 2 in the circumferential direction, the growth of the cracks can be suppressed at the step portions 34. As a result, it is possible to suppress a situation that the heat generated in the heat-generating resistor 3 is less prone to be transmitted to the substrate.

Further, when each shape to be deviated is semicircular, a major region of the outer periphery part of the heat-generating resistor 3 has an arc shape. This reduces a possibility that damage is caused by a thermal stress between the heat-generating resistor 3 and the ceramic body 2. Here, the shape of each "semicircular portion 33" mentioned here is not limited to that obtained by dividing a circle. A shape obtained by dividing an ellipse may be employed. Alternatively, a shape obtained by dividing an elongated circle may be employed. Further, a shape obtained by dividing a distorted circle may be employed. Further, the expression "bisected in the diametrical direction" mentioned here indicates a state of being bisected approximately in the center. When the two semicircular portions 33 have the same chord length, for example, the two semicircular portions 33 may deviate from each other by 20 to 100 μm. Here, the expression "deviate" mentioned here is used merely for convenience in expressing the shape of the heat-generating resistor 3 and does not limit the manufacturing method for the heat-generating resistor 3. That is, the heat-generating resistor 3 may be not composed of two members and may be formed in an integrated manner. For example, employable methods of forming the heat-generating resistor 3 in an integrated manner include injection molding.

Further, in the heat-generating resistor 3, the step portions 34 extend continuously along the longitudinal direction of the ceramic body 2. More specifically, the two step portions 34 are provided along the entirety of each of the two straight parts 31 of the heat-generating resistor 3. By virtue of this, growth of the cracks can be suppressed extensively.

Further, in the heat-generating resistor 3, it is preferable that the step portion 34 is located at least on the inner side of the folded part 32. Here, in the heater 1, the step portions 34 are located on both of the inner side and the outer side of the folded part 32. Then, the step portions 34 provided on the inner side and the outer side of the folded part 32 are continuous to the two step portions 34 provided in each of the two straight parts 31. Heat is easily accumulated on the inner side of the folded part 32 so that a high temperature is easily reached and hence a thermal stress is easily caused in this portion. However, when the step portion 34 is provided in this portion, growth of the cracks can be suppressed effectively.

Further, when the step portion 34 is provided on the outer side of the folded part 32, the surface area of a region of the heat-generating resistor 3 close to the surface of the ceramic body 2 can be ensured large. As a result, the heat can easily be transmitted to the surface of the ceramic body 2 and hence the temperature rise rate of the heater 1 can be improved.

Figure 3:
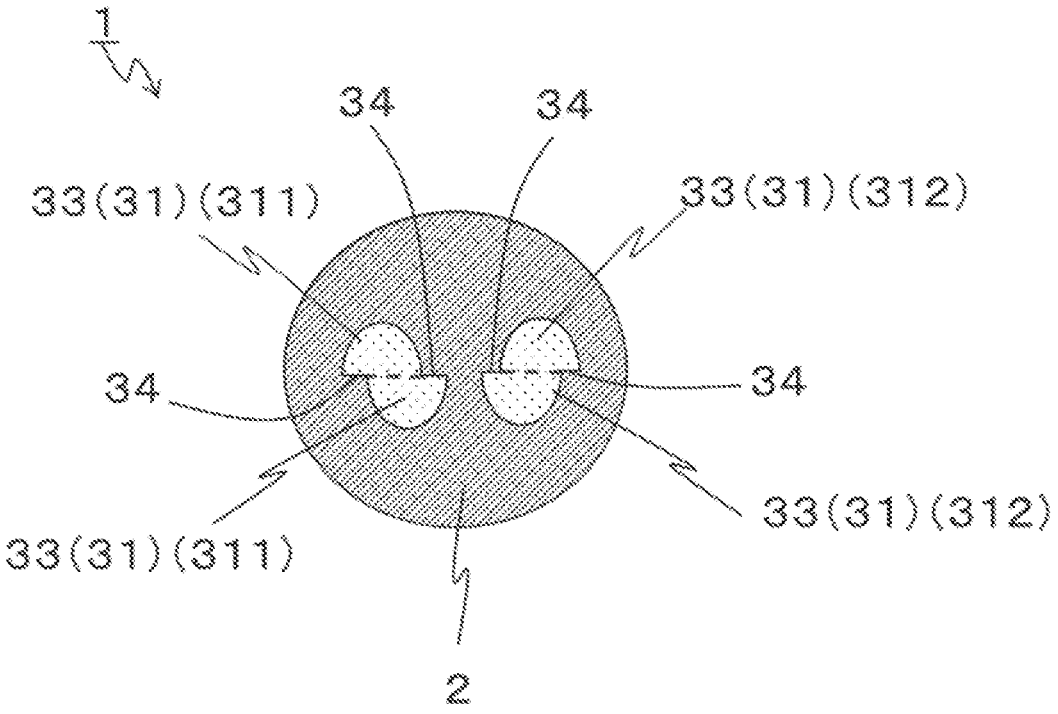
FIG. 3 is a sectional view showing a modified example of a heater.

Further, as shown in FIG. 3, the semicircular portions 33 may deviate from each other in each of the two straight parts 31 and then deviation directions of the semicircular portions 33 may be opposite to each other in the two straight parts 31. Specifically, in FIG. 3, the straight part 31 located on the left side is referred to as a first straight part 311, and the straight part 31 located on the right side is referred to as a second straight part 312. Then, in the first straight part 311, the semicircular portion 33 located on the upper side in FIG. 3 deviates leftward and the semicircular portion 33 located on the lower side deviates rightward. In the second straight part 312, the semicircular portion 33 located on the upper side in FIG. 3 deviates rightward and the semicircular portion 33 located on the lower side deviates leftward.

When the semicircular portions 33 deviate from each other in each of the two straight parts 31 and the deviation directions of the semicircular portions 33 in the two straight parts 31 align with an arrangement direction of the two straight parts 31, the heat-generating resistor 3 can be distributed widely in the arrangement direction. By virtue of this, the heat uniformity of the heater 1 can be improved. Here, the expression "the deviation directions align with the arrangement direction of the two straight parts 31" mentioned here does not indicate that the deviation directions and the arrangement direction are exactly the same as each other. Specifically, the deviation directions may be inclined at about 30° relative to the arrangement direction.

Further, when the deviation directions of the semicircular portions 33 in the two straight parts 31 are opposite to each other, a possibility can be reduced that when cracks occur in one of the two straight parts 31, the cracks grow toward the other one of the two straight parts 31. Specifically, when cracks occur in the arc-shaped region of the semicircular portion 33, the cracks tend to easily grow along the arc-shaped portion of the semicircular portion 33. Then, the cracks having grown along the arc-shaped portion reach the step portion 34 and, after that, possibly grow along an extension line of the arc-shaped portion. Then, as in the heater 1 shown in FIG. 3, in a case where the deviation directions of the semicircular portions 33 in the two straight parts 31 are opposite to each other, even when cracks occur in one straight part 31 and then the cracks grow along the extension line of the arc-shaped portion, cracks is less prone to grow to the arc-shaped portion of the semicircular portion 33 of the other straight part 31. This is because, since the deviation directions of the semicircular portions 33 are opposite to each other, it is possible to avoid that the arc-shaped portion of one straight part 33 is located along the extension line of the arc-shaped portion of the semicircular portion 33 of the other straight part or in the vicinity thereof.

Figure 4:
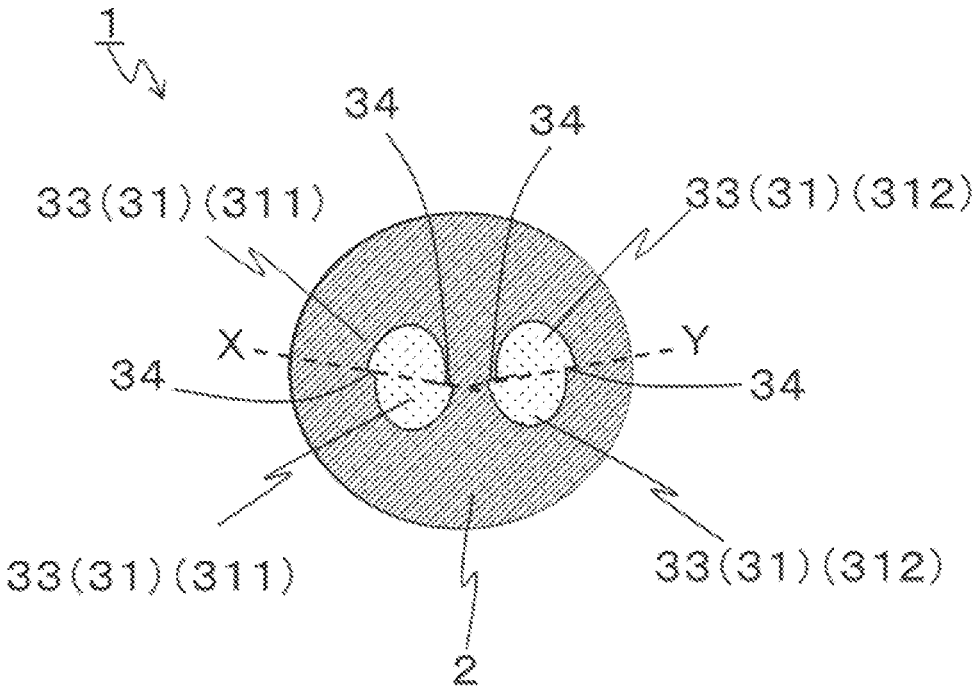
FIG. 4 is a sectional view showing a modified example of a heater.

Further, as shown in FIG. 4, the semicircular portions 33 may deviate from each other in each of the two straight parts 31 and then a first imaginary line X joining together the two step portions 34 in the first straight part 311 and a second imaginary line Y joining together the two step portions 34 in the second straight part 312 may intersect with each other. By virtue of this, even when cracks occur in the step portion 34 in the first straight part 311 and then grow along the extension line of the straight portion of the step portion 34, a possibility can be reduced that the cracks grow even to the step portion in the second straight part 312. This reduces a possibility of occurrence of dielectric breakdown between the two straight parts 31. For example, the angle of intersection between the first imaginary line X and the second imaginary line Y may be set to be 5° to 40°. In particular, it is effective that the angle of intersection between the first imaginary line X and the second imaginary line Y is set to be 15° to 30°.

Figure 5:
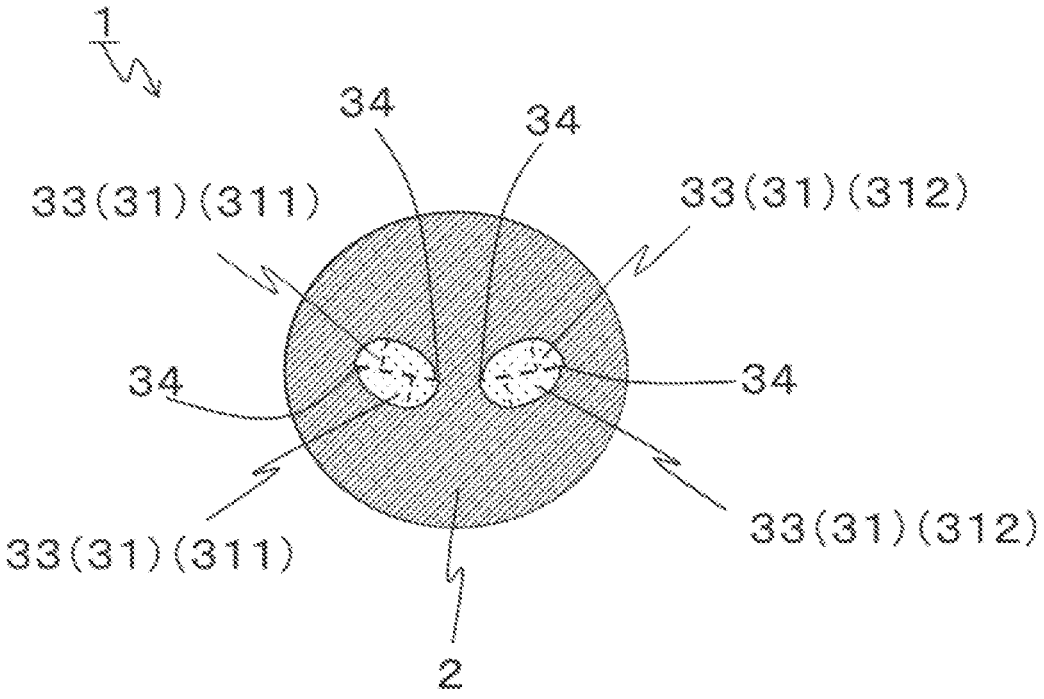
FIG. 5 is a sectional view showing a modified example of a heater.
Figure 6:
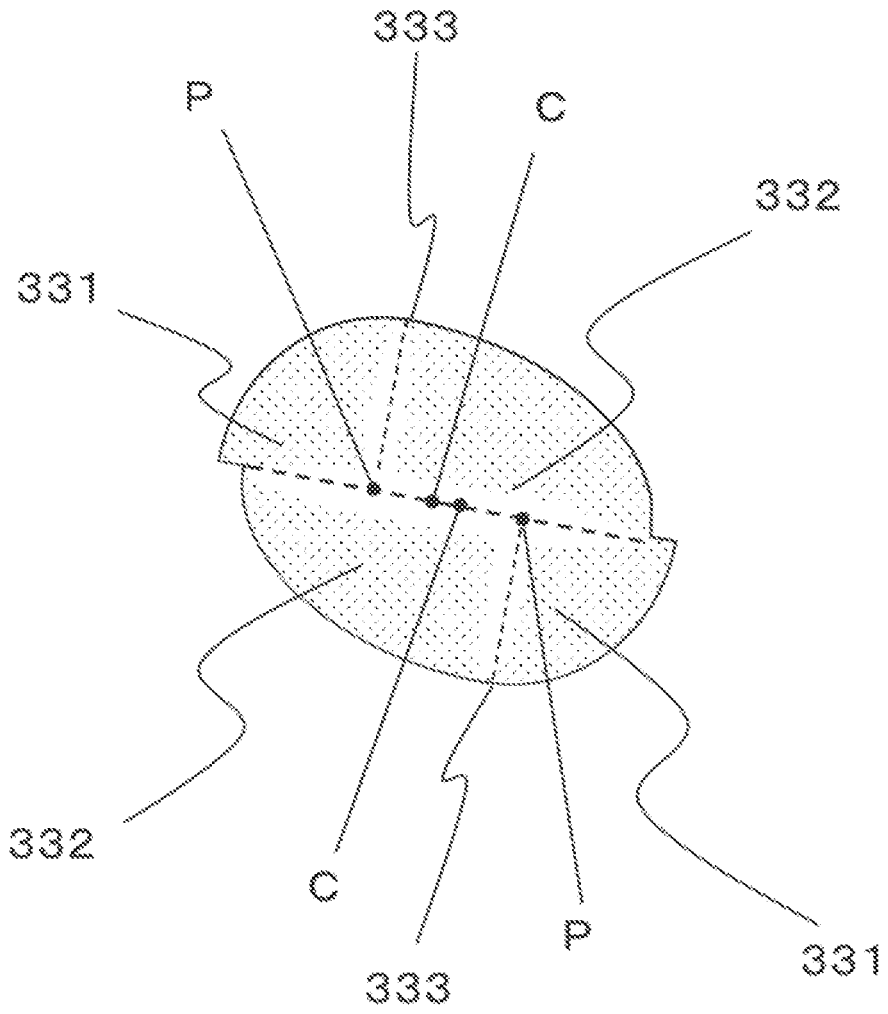
FIG. 6 is a partial sectional view showing a heat-generating resistor alone in FIG. 5.

Further, as shown in FIGS. 5 and 6, each semicircular portion 33 may have a first region 331 and a second region 332. The semicircular portion 33 shown in FIGS. 5 and 6 is composed solely of the first region 331 and the second region 332. Each of the first region 331 and the second region 332 has the shape of a quarter circle and these regions are located adjacent to each other. The first region 331 is a region located on a deviation side of the semicircular portions 33. The shape of a quarter circle mentioned here does not indicate the shape of an exact quarter circle and hence the shape is not limited to that obtained by dividing a circle into four portions. A shape obtained by dividing an ellipse into four portions may be employed. Alternatively, a shape obtained by dividing an elongated circle into four portions may be employed. Further, a shape obtained by dividing a distorted circle into four portions may be employed. Then, the first region 331 has a smaller curvature radius than that of the second region 332.

As such, when the first region 331 and the second region 332 have different curvature radii from each other, the cracks can be made difficult to grow from the arc portion of the first region 331 to the arc portion of the second region 332. Further, the first region 331 is a region located on the deviation side of the semicircular portions 33 in the heat-generating resistor 3. By virtue of this, in particular, it is possible to suppress a situation that the cracks generated in the tip part of the step portion 34 where a stress is easily concentrated would grow along the arc-shaped portion. Here, the tip part of the step portion 34 mentioned here indicates the portion of a corner formed by the arc-shaped portion and the chord portion of the semicircular portion 33.

Further, as shown in FIG. 6, apexes 333 of arcs of the respective semicircular portions 33 bisected may deviate from each other in the deviation direction of the semicircular portions 33. Within the heat-generating resistor 3, a stress is prone to be concentrated on the step portions 34 and the apex 333. When the apices 33 are located in a deviated manner from each other in the two semicircular portions, it is possible to suppress a situation that when stresses occur in the two apices 333, these stresses are superimposed. This reduces a possibility of occurrence of cracks in the heat-generating resistor 3.

Further, as shown in FIG. 6, an imaginary line perpendicularly intersecting with the chord of each semicircular portion 33 is drawn from the apex 333 of the arc of each semicircular portion 33 bisected, and then the point of intersection between the imaginary line and the chord is referred to as a reference point P. At that time, the reference point P may be located in the deviation direction of the semicircular portions 33 relative to the center C of the chord of the semicircular portion 33. By virtue of this, the shape of the arc of the semicircular portion 33 is allowed to be made different on both sides of the apex 333 and hence growth of the cracks can easily be reduced at the apex 333.

Figure 7:
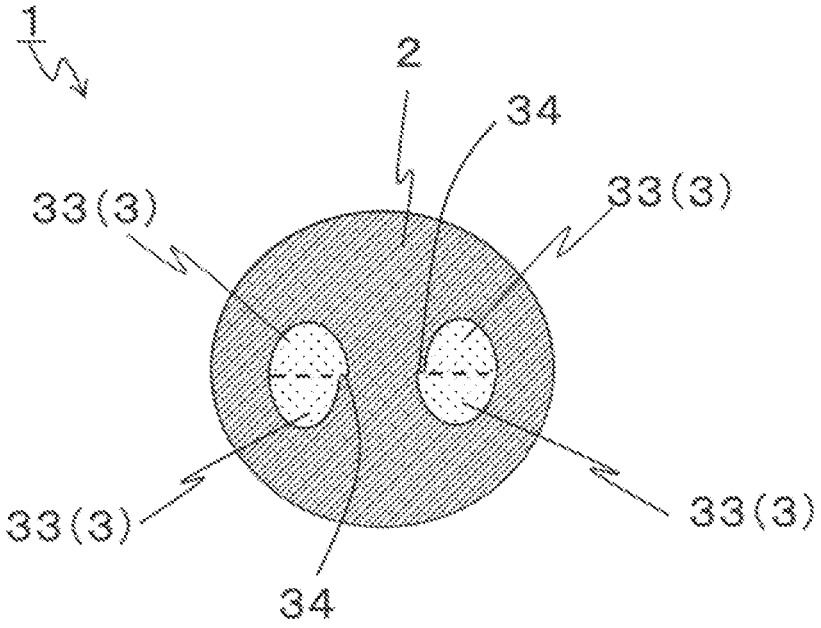
FIG. 7 is a sectional view showing a modified example of a heater.

Further, as shown in FIG. 7, the semicircular portions 33 having different sizes may deviate from each other in the diametrical direction so that one step portion 34 alone may be formed in each one straight part 31. Further, one step portion 34 alone may be formed in the folded part 32. Even in this case, growth of the cracks can be suppressed at the step portion 34. As a result, it is possible to suppress a situation that the heat generated in the heat-generating resistor 3 is less prone to be transmitted to the substrate.

Figure 8:
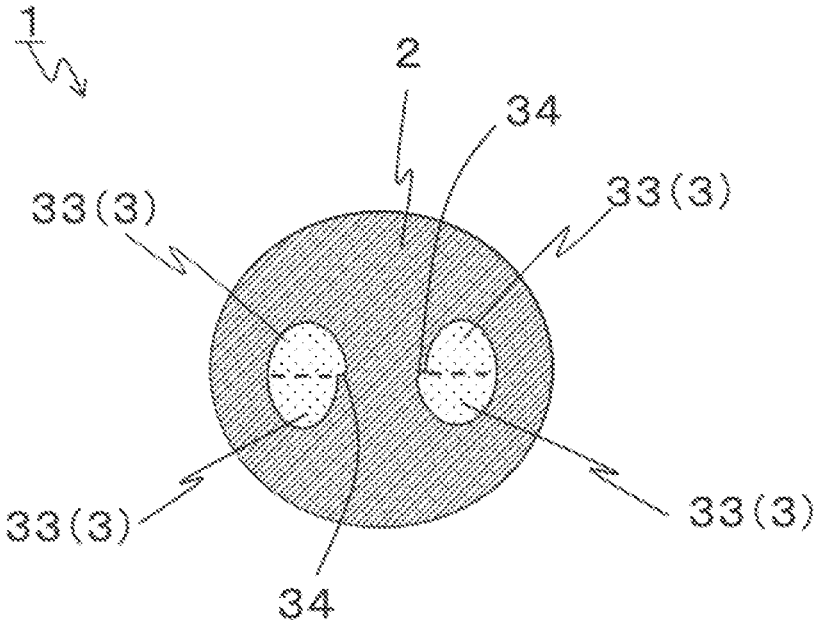
FIG. 8 is a sectional view showing a modified example of a heater.

Further, as shown in FIG. 8, the tip part of each step portion 34 may have an R-shape. When the tip part of the step portion 34 has an R-shape, it is possible to suppress a situation that a thermal stress is concentrated on the tip part of the step portion 34. As a result, long term reliability under heat cycles can be improved. As for the size of the R-shape, for example, the curvature radius may be set to be 10 to 100 μm.

Returning to FIG. 1, leads 4 are members for electrically connecting the heat-generating resistor 3 to an external power supply. The leads 4 are connected to the heat-generating resistor 3 and drawn out to the surface of the ceramic body 2. Specifically, the leads 4 are respectively joined to both end parts of the heat-generating resistor 3. Then, in one lead 4, one end side is connected to one end of the heat-generating resistor 3 and the other end side is extracted from the side face of the ceramic body 2 near the rear end. In the other lead 4, one end side is connected to the other end of the heat-generating resistor 3 and the other end side is extracted from the rear end part of the ceramic body 2.

For example, each lead 4 is formed of a similar material to that of the heat-generating resistor 3. The lead 4 has a larger cross-sectional area than that of the heat-generating resistor 3 or, alternatively, has a lower content of the formation material of the ceramic body 2 than that of the heat-generating resistor 3 so that the resistance per unit length is made low. In particular, from the perspectives of a small difference in the thermal expansion coefficient from the ceramic body 2, a high heat resistance, and a low specific resistance, WC is preferable as the material of the lead 4. Further, the lead 4 is preferably prepared so that WC serving as an inorganic electroconductive material is employed as the main component and silicon nitride is added in a content of 15 mass % or higher. With increasing content of silicon nitride, the thermal expansion coefficient of the lead 4 becomes close to the thermal expansion coefficient of silicon nitride constituting the ceramic body 2. Further, when the content of silicon nitride is 40 mass % or lower, the resistance of the lead 4 becomes low and stable. Thus, it is preferable that the content of silicon nitride is 15 mass % to 40 mass %. More preferably, the content of silicon nitride is 20 mass % to 35 mass %.

Figure 9:
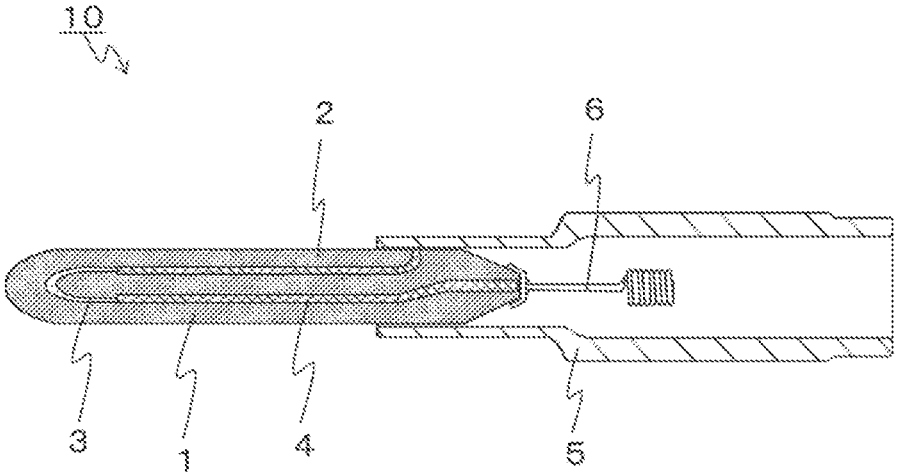
FIG. 9 is a sectional view showing an example of an embodiment of a glow plug.

As shown in FIG. 9, a glow plug 10 includes: the heater 1 described above; and a cylindrical metal tube 5 attached so as to cover the rear end side (the other end side) of the heater 1. The glow plug 10 further includes an electrode metal fitting 6 arranged in the inner side of the metal tube 5 and attached to the rear end of the heater 1. According to the glow plug 10, since the above-mentioned heater 1 is employed, growth of cracks along the interface between the heat-generating resistor and the ceramic body is suppressed and hence durability can be improved.

The metal tube 5 is a member for holding the ceramic body 2. The metal tube 5 is a cylindrical member and attached so as to surround the rear end side of the ceramic body 2. That is, the ceramic body 2 having a bar shape is inserted into the cylindrical metal tube 5. The metal tube 5 is electrically connected to a portion provided in the side face on the rear end side of the ceramic body 2 where the lead 4 is exposed. For example, the metal tube 5 is formed of stainless steel or an iron (Fe)-nickel (Ni)-cobalt (Co) alloy.

The metal tube 5 and the ceramic body 2 are joined together with a brazing material. The brazing material is provided between the metal tube 5 and the ceramic body 2 so as to surround the rear end side of the ceramic body 2. When this brazing material is provided, the lead 4 and the metal tube 5 are electrically connected together.

As the brazing material, a silver (Ag)-copper (Cu) brazing material, a Ag brazing material, a Cu brazing material, or the like containing 5 to 20 mass % of a glass component may be employed. The glass component has satisfactory wettability with ceramics of the ceramic body 2 and hence has a high friction coefficient. Thus, the joining strength between the brazing material and the ceramic body 2 or the joining strength between the brazing material and the metal tube 5 can be improved.

The electrode metal fitting 6 is located in the inner side of the metal tube 5 and attached to the rear end of the ceramic body 2 so as to be electrically connected to the lead 4. The electrode metal fittings 6 of various forms may be employed. However, in the example shown in FIG. 9, there is employed such a configuration that a cap part attached so as to cover the rear end of the ceramic body 2 including the lead 4 and a coil-shaped part electrically connected to an external connecting electrode are connected together in a line-shaped part. The electrode metal fitting 6 is held and separated from the inner peripheral surface of the metal tube 5 so that a short circuit does not occur relative to the metal tube 5.

The electrode metal fitting 6 is a metal wire having the coil-shaped part and provided for stress relaxation at the time of connection to an external power supply. The electrode metal fitting 6 is electrically connected to the lead 4 and electrically connected to the external power supply. When a voltage is applied between the metal tube 5 and the electrode metal fitting 6 by the external power supply, an electric current flows through the heat-generating resistor 3 via the metal tube 5 and the electrode metal fitting 6. For example, the electrode metal fitting 6 is formed of nickel or stainless steel.

Next, an example of a method for manufacturing the heater 1 is described below.

For example, the heater 1 may be formed by injection molding or otherwise that employs a mold for the shapes of the heat-generating resistor 3, the leads 4, and the ceramic body 2 of the above-mentioned configuration. As for the heat-generating resistor 3, first, two molded bodies are prepared each of which has a semicircular cross section and includes a straight part and a folded part. Then, the two molded bodies are stacked together so that the semicircular portions deviate from each other in the diametrical direction. After that, firing is performed under pressure. By virtue of this, there is obtained the heat-generating resistor 3 in which the semicircular portions deviate from each other in the diametrical direction.

First, electroconductive paste containing electroconductive ceramic powder, resin binder, and the like so as to constitute the heat-generating resistor 3 and the leads 4 is prepared, and ceramic paste containing insulating ceramic powder, resin binder, and the like so as to constitute the ceramic body 2 is prepared.

Next, an electroconductive-paste molded body having a predetermined pattern serving as the heat-generating resistor 3 is formed by injection molding using the electroconductive paste. At that time, by preparing a mold having a desired shape, the heat-generating resistor 3 having the step portions 34 can be formed. Then, in a state where the heat-generating resistor 3 is held in the mold, the electroconductive paste is injected into the mold so that the electroconductive-paste molded body having the predetermined pattern serving as the leads 4 is formed.

Next, in a state where the heat-generating resistor 3 and a part of the leads 4 are held in the mold, a part of the mold is changed to one for molding of the ceramic body 2. After that, the ceramic paste constituting the ceramic body 2 is injected into the mold. By virtue of this, there is obtained a molded body of the heater 1 in which the heat-generating resistor 3 and the leads 4 are covered by the ceramic-paste molded body.

Next, the obtained molded body is fired, for example, at a temperature of 1650° C. to 1780° C. and a pressure of 30 MPa to 50 MPa so that the heater 1 is obtained. Here, it is preferable that the firing is performed in a state where the molded body is held in a carbon mold and the carbon mold is filled with carbon powder so that the influence of oxygen in the atmosphere is reduced. Further, the firing may be performed in a non-oxidizing gas atmosphere such as nitrogen gas or hydrogen gas.

REFERENCE SIGNS LIST

1: Heater
2: Ceramic body
3: Heat-generating resistor
31: Straight part
32: Folded part
33: Semicircular portion
34: Step portion

4: Lead
5: Metal tube
6: Electrode metal fitting
10: Glow plug

The invention claimed is:

1. A heater, comprising:

a ceramic body having a bar shape; and a heat-generating resistor disposed inside the ceramic body, when viewed in a transverse section, the heat-generating resistor comprising at least one pair of semicircular portions, such that each of the semicircular portions of each of the at least one pair of semicircular portions are axially offset from a center axis of the heat-generating resistor when viewed in the transverse section, wherein each offset semicircular portion forms a step portion that bisects the pair of semicircular portions in a diametrical direction of the heat-generating resistor.

2. The heater according to claim 1, wherein in the heat-generating resistor, the step portion extends continuously in a longitudinal direction of the ceramic body.

3. The heater according to claim 1, wherein the heat-generating resistor comprises a folded part, and the step portion is located on an inner side of the folded part.

4. The heater according to claim 1, wherein in the heat-generating resistor, a tip part of the step portion has an R-shape.

5. The heater according to claim 1, wherein the heat-generating resistor includes two straight parts extending along a longitudinal direction of the ceramic body; and a folded part for linking together the two straight parts, and in each of the two straight parts, the at least one pair of semicircular portions deviate from each other and deviation directions of the at least one pair of semicircular portions in the two straight parts align with an arrangement direction of the two straight parts.

6. The heater according to claim 5, wherein the deviation directions of the at least one pair of semicircular portions in the two straight parts are opposite to each other.

7. The heater according to claim 1, wherein the heat-generating resistor includes a first straight part and a second straight part which extend along a longitudinal direction of the ceramic body; and a folded part for linking together the first straight part and the second straight part, and the first straight part has two step portions, and an imaginary line joining the two step portions of the first straight part is referred to as a first imaginary line, the second straight part has two step portions, and an imaginary line joining the two step portions of the second straight part is referred to as a second imaginary line, and the first imaginary line and the second imaginary line intersect with each other.

8. The heater according to claim 1, wherein the pair of semicircular portions each include a first region having a quarter circle shape and a second region having a quarter circle shape, and the first region has a smaller curvature radius than that of the second region.

9. The heater according to claim 8, wherein the first region is a region located on a deviation side of the at least one pair of semicircular portions in the heat-generating resistor.

10. The heater according to claim 1, wherein apexes of arcs of the respective semicircular portions bisected deviate from each other in a deviation direction of the at least one pair of semicircular portions.

11. The heater according to claim 1, wherein when an imaginary line is drawn from the apex of the arc of each of the at least one pair of semicircular portions so as to perpendicularly intersect with a chord of each of the at least one pair of semicircular portions and a point of intersection between the imaginary line and the chord of each of the at least one pair of semicircular portions is referred to as a reference point, the reference point is located on a deviation side of the at least one pair of semicircular portions relative to the center of the chord of each of the at least one pair of semicircular portions.

12. A glow plug, comprising:

a heater according to claim 1, the heat-generating resistor being located on one end side of the ceramic body; and a metal tube disposed so as to cover the other end side of the ceramic body.

* * * * *